US007121550B1

(12) United States Patent
Lo

(10) Patent No.: US 7,121,550 B1
(45) Date of Patent: Oct. 17, 2006

(54) CARD GAME

(76) Inventor: Henry Tien Lo, 5010 Indian River Dr., Apartment 32, Las Vegas, NV (US) 89103

( * ) Notice: Subject to any disclaimer, the term of this patent is extended or adjusted under 35 U.S.C. 154(b) by 0 days.

(21) Appl. No.: 09/688,277

(22) Filed: Oct. 12, 2000

Related U.S. Application Data

(63) Continuation-in-part of application No. 09/315,295, filed on May 20, 1999, now Pat. No. 6,402,147.

(60) Provisional application No. 60/086,110, filed on May 20, 1998.

(51) Int. Cl.
*A63F 1/00* (2006.01)

(52) U.S. Cl. ..... 273/292

(58) Field of Classification Search ..... 273/292, 273/309, 274, 303; 463/1, 7, 11–13, 25–27
See application file for complete search history.

(56) References Cited

U.S. PATENT DOCUMENTS 5,255,915 A * 10/1993 Miller ..... 463/13
5,275,415 A * 1/1994 Wisted ..... 273/274
5,288,082 A * 2/1994 Marquez ..... 273/292
5,294,128 A * 3/1994 Marquez ..... 273/292
5,411,268 A * 5/1995 Nelson et al. ..... 273/292
5,678,821 A * 10/1997 Hedman ..... 273/292
5,735,524 A * 4/1998 Wisted ..... 273/274
5,810,361 A * 9/1998 Kadlic ..... 273/292
5,839,731 A * 11/1998 Feola ..... 273/292
5,863,042 A * 1/1999 Lo ..... 273/292
5,984,310 A * 11/1999 English ..... 273/292
5,997,002 A * 12/1999 Goldman ..... 273/292
6,012,720 A * 1/2000 Webb ..... 273/292
6,019,374 A * 2/2000 Breeding ..... 273/292
6,102,402 A * 8/2000 Scott et al. ..... 273/292
6,206,373 B1 * 3/2001 Garrod ..... 273/292
6,402,147 B1 * 6/2002 Lo ..... 273/292
6,588,757 B1 * 7/2003 Lo ..... 273/292
2001/0048197 A1 * 12/2001 Lo
2001/0054796 A1 * 12/2001 Lo
2002/0036381 A1 * 3/2002 Scibetta
2003/0197331 A1 * 10/2003 Lo ..... 273/292
2004/0254005 A1 * 12/2004 Shackleford et al. ..... 463/13

(Continued)

OTHER PUBLICATIONS

U.S. Appl. No. 09/823,571, Henry Tien Lo.

*Primary Examiner*—Stephen Blau
*Assistant Examiner*—Dolores R. Collins
(74) *Attorney, Agent, or Firm*—Gerry J. Elman; Elman Technology Law, P.C.

(57) ABSTRACT

The card game of the present invention is a seven-card stud poker game, played with at least one but preferably one standard deck of 52 cards plus at least one but preferably one Joker. Two or more players, preferably seven players, may participate in any given round of play. One of the players is the Banker whom other players play against. A Player who is not the Banker may play Poker Bet against the Banker's hand and/or Pair Of Aces Or Better Bet on the contents of the Player's own hand. After at least one wager is placed, each Player and the Banker is dealt seven cards. The Player's Poker Bet wager wins if the Player's best 5-card poker hand (selected from the Player's own seven cards) beats the Banker's best 5-card poker. The Player's Pair Of Aces Or Better Bet wager wins if the Player's best 5-card poker hand is a pair of Aces or a better hand. Poker Bet and Pair Of Aces Or Better Bet are two independent wagers and are settled separately.

16 Claims, 2 Drawing Sheets

U.S. PATENT DOCUMENTS

2005/0001378 A1* 1/2005 Lo ..... 273/292

2006/0027966 A1* 2/2006 Consolo ..... 273/292

* cited by examiner

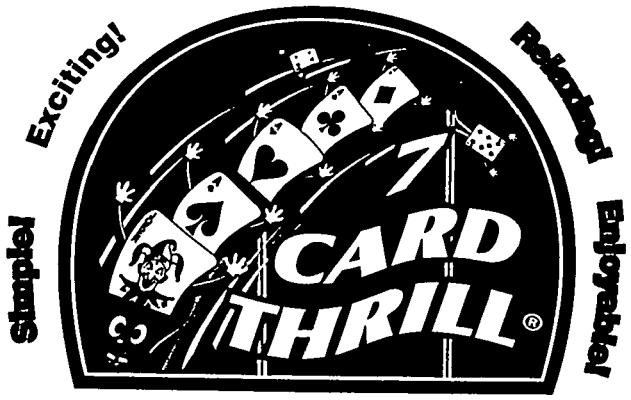

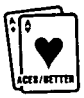

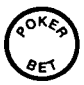

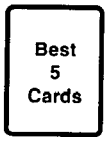

2
Discards

7 CARD THRILL is a simplified version of PAI GOW POKER, played with a standard poker deck of 52 cards plus one *"Joker."* The *Joker* can be used as an *Ace,* or to form a *Straight or Flush.* After you have made either one or both of the bets: POKER BET against the Dealer's hand and PAIR OF ACES OR BETTER BET on the value of your own hand, you will be dealt 7 cards. You then must select your best 5-card poker hand from your 7 cards; and the Dealer does the same (from the Dealer's 7 cards).

POKER BET

The object of the game is to have a better hand than the Dealer's hand. Your best 5-card poker hand is compared with the Dealer's best 5-card poker hand according to traditional poker rankings: *5 Aces, Royal Flush, Straight Flush, 4 of a Kind, Full House, Flush, Straight, 3 of a Kind, Two Pair, One Pair* and *High Card.* In 7 CARD THRILL, *A, 2, 3, 4, 5* is the second highest *Straight* and second highest *Straight Flush* when suited.

YOU WIN if your best 5-card poker hand beats the Dealer's best 5-card poker hand, and you will either be paid Even Money (1 to 1) in most cases, or be paid *"half" of your wager when the Dealer's losing hand is "King-Jack" or "lower."*

Same ranking hands push. If the Dealer's hand beats yours, you lose your wager.

PAIR OF ACES OR BETTER BET

YOU WIN if your best 5-card poker hand is a *pair of Aces* or *better.* If it is any other type of hand, you lose your wager.

*Two Pair* or *Better* . . . . . 1 to 1
*2* or *More Aces*. . . . . 1 1/2 to 1

Note: Be sure to show the Dealer your *Aces* to be paid 1 1/2 of your wager before splitting or discarding them to select your best 5-card poker hand.

© FIVE STAR GAMING, Patent Pending. All Rights Reserved.

Fig. 2

CARD GAME

CROSS REFERENCE TO RELATED APPLICATION

This application is a continuation-in-part application of application Ser. No. 09/315,295, filed May 20, 1999, entitled "Card Game", now U.S. Pat. No. 6,402,147. This application claims the benefit of U.S. provisional patent application Ser. No. 60/086,110, filed May, 20, 1998.

FIELD OF THE INVENTION

The present invention generally relates to card games and, in particular, to card games for use in casinos and cardrooms.

SUMMARY OF THE INVENTION

The present invention is a seven-card-stub poker game, played with at least one but preferably one standard poker deck of 52 cards plus at least one but preferably one Joker. The "Joker" may be used as an Ace or to form a Straight or Flush. Two or more players, preferably seven players, may participate in any given round of play. One of the players is the Banker whom other players play against. A Player who is not a Banker may play Poker Bet against the Banker's hand and/or Pair Of Aces Or Better Bet on the contents of the Player's own hand. After at least one wager is placed, each Player and the Banker is dealt seven cards. From each Player's own seven cards, each Player selects his or her best 5-card poker hand as his or her keeper hand and discards two other cards, which are treated as two discards; i.e., from the Player's seven dealt cards KKQJ982, KKQJ9 is the Player's best 5-card poker hand and 82 are the two discards; from AAKQ933, AA33K is the best 5-card poker hand and Q9 are the two discards. From the Banker's seven cards, the Banker selects the Banker's best 5-card poker hand as the Banker's keeper hand and discards two other cards.

Poker Bet allows a Player to place a wager against the Banker's hand. The object of Poker Bet is to have a best 5-card poker that outranks the Banker's best 5-card poker hand. In Poker Bet, the Player's best 5-card poker hand is compared to the Banker's best 5-card poker hand according to traditional poker rankings, wherein hands are ranked in descending order as follows: 5 Aces, Royal Flush, Straight Flush, 4 of a Kind, Full House, Flush, Straight, 3 of a Kind, Two Pair, One Pair and High Card. Ace is the highest High Card, following by King, Queen, Jack, Ten, 9, 8, 7, 6, 5, 4, 3 and 2 (the lowest High Card). Ace, 2, 3, 4, 5 is the $2^{nd}$ highest Straight, behind AKQJ10 (Royal Flush).

This Poker Bet wager wins if the Player's best 5-card poker hand outranks the Banker's best 5-card poker hand, and is paid either Even Money (1 to 1) or one half of the wager (1 to 2) if the Banker's losing best 5-card poker hand is a King-Jack-high hand or a lower hand; i.e., the best 5-card poker hand KJ986 is a King-Jack-high hand or Q9875 is a lower hand. This wager loses if the Player's best 5-card ranks lower than the Banker's. If the Player's and the Banker' best 5-card poker hand rank the same, two hands push and this wager neither wins nor loses. This payout odds yields a house advantage of 2.17%.

Pair Of Aces Or Better Bet allows a Player to bet on the contents of the Player's own unseen hand. This wager wins if the Player's best 5-card poker hand is a pair of Aces or better (Two Pair, 3 of a Kind, Straight, Flush, Full House, 4 of a Kind, Straight Flush, Royal Flush or 5 Aces); this wager loses if the Player's best 5-card poker hand is any other type of hand. This winning wager is paid Even Money (1 to 1) on a hand of Two Pair or better, and is paid one and one half of the wager (3 to 2) on a hand that has two or more Aces in either the Player's best 5-card poker hand or the Player's own seven cards. This payout odds yields a house advantage of 1.81%

It is a primary object of the invention to create, by using familiar elements of traditional poker games, a game that is simple, exciting and relaxing, and can be easily learned, played and enjoyed by everyone. It is another primary object to create Pair Of Aces Or Better Bet that resembles slot machine payoff: skill is not required for a return. It is another object to allow Players to play two even-money bets per hand, enhancing the action at the table. It is a further object to create an embodiment that can be a casino game, which is played in a friendly, social atmosphere of a casino setting. It is another further object to create an embodiment that can be a cardroom game, which is played in a cardroom setting where players play against a Player-Banker (a non-house Banker). Another object is to provide players a speedy and more exciting way to enjoy the popular Pai Gow Poker game. An embodiment of this invention is offered under the trademark "7 Card Thrill."

BRIEF DESCRIPTION OF THE DRAWINGS

FIG. 2 is a rules card for a casino card game of the invention.

DESCRIPTION OF PREFERRED EMBODIMENTS

Figure 1:
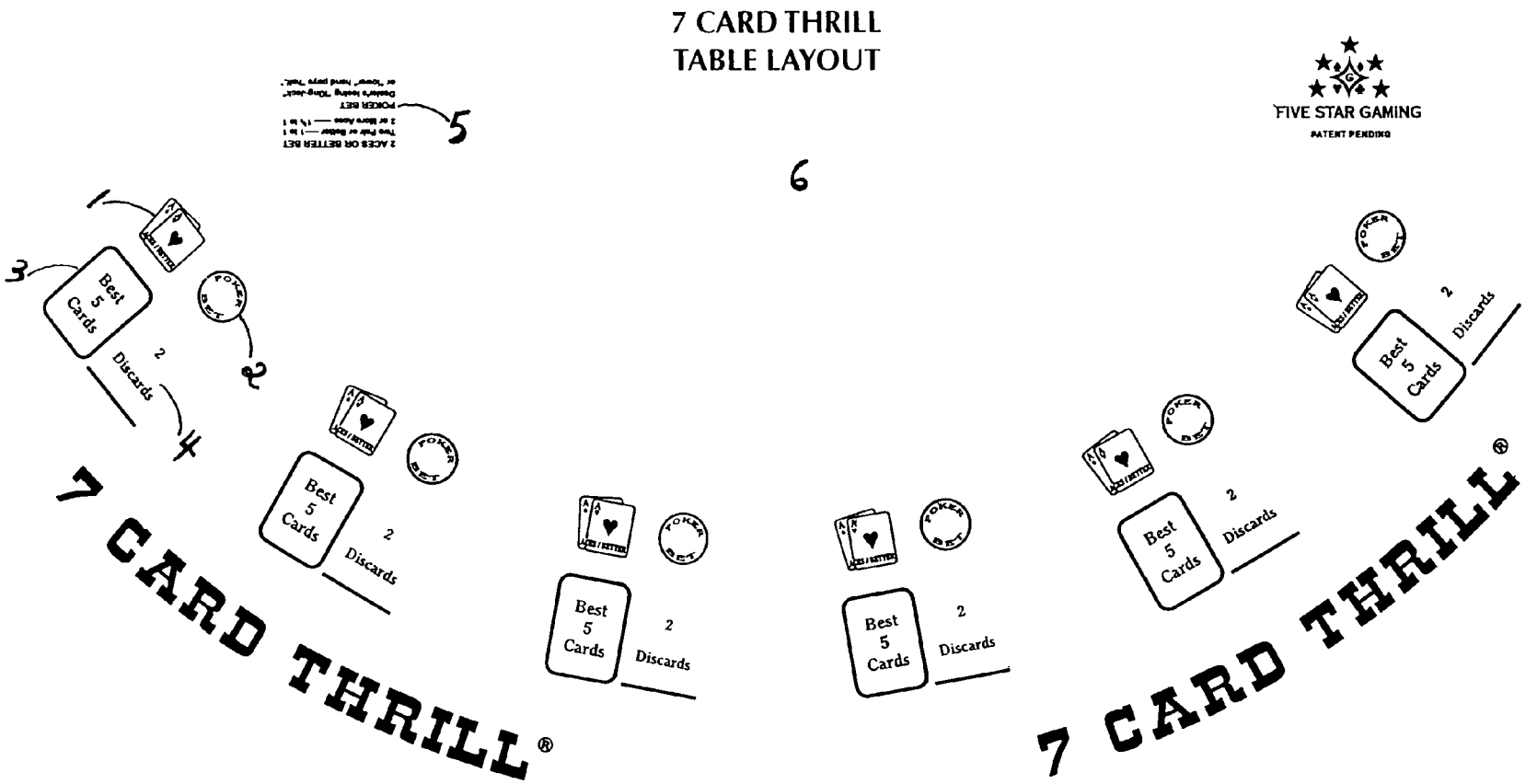
FIG. 1 is a preferred layout of a casino card table of the invention.

In the preferred embodiment of the invention provides a seven-card stud poker game, played with one standard poker deck of 52 cards plus one Joker. Other embodiments include versions that would be played with at least one standard poker deck of 52 cards plus at least one Joker. Another embodiment includes a version that would be played with at least one standard deck of 52 cards with no Joker.

In the preferred embodiment, the Joker is "semi-wild" and may be used as an Ace, or to form a Straight, Flush, Straight Flush or Royal Flush. In another embodiment, the Joker is "wild" and may be used as any card; this alters the odds, payoffs and house advantages from the preferred embodiment and adds twelve (12) more ranking hands of 5 Deuces through 5 Kings to the ranking hands of the preferred embodiment.

In the preferred embodiment, two or up to seven players may participate in any given round of play and one of them is the Banker whom other players play against. In another embodiment, two or up to the number of players that the cards are dealt into enough dealt hands of seven cards to provide a dealt hand for each Player and for the Banker, may participate in any given round of play.

A Player who is not a Banker may play Poker Bet against the Banker's hand and/or Pair Of Aces Or Better Bet on the contents of the Player's own hand. Poker Bet and Pair Of Aces Or Better Bet are two independent wagers and are settled separately, regardless of the outcome of each other. After at least one wager is placed, each Player and the Banker is dealt seven cards. Once having delivered the cards to all players, the dealer turns over the Banker's seven cards with only the top card exposed. From each Player's own seven cards, each Player selects his or her best 5-card poker hand and discards two other cards, then each Player places his or her cards on the appropriate spaces of the table layout. The dealer then reveals the Banker's six remaining cards, selects the Banker's best 5-card poker hand, discards two other cards, settles each Player's Pair Of Aces Or Better Bet wager first, and then settles each Player's Poker Bet wager.

Poker Bet

The object of Poker Bet is to have a best 5-card poker that outranks the Banker's best 5-card poker hand. In Poker Bet, a Player's best 5-card poker hand is compared to the Banker's best 5-card poker hand according to traditional poker rankings, which are ranked in descending order as follows: 5 Aces, Royal Flush, Straight Flush, 4 of a Kind, Full House, Flush, Straight, 3 of a Kind, Two Pair, One Pair and High Card. Ace is the highest High Card, following by King, Queen, Jack, Ten, 9, 8, 7, 6, 5, 4, 3 and 2.

In the preferred embodiment, A2345 is the second highest Straight, behind AKQJ10. In another embodiment, A2345 is the lowest Straight, behind 23456. Changing the ranking of A2345 does not effect the odds of the related embodiments.

The Poker Bet wager may be settled with either one of the following embodiments:

In a preferred embodiment, if the Player's hand (best 5-card poker hand) ranks lower than the Banker's hand (best 5-card poker hand), this wager loses. If the Player's and the Banker's hand rank the same, then two hands push and this wager neither wins nor loses. If the Player's hand ranks higher than the Banker's, this wager wins and is paid either Even Money (1 to 1) or one half of the wager (1 to 2) if the Banker's losing hand is King-Jack or lower.

In another embodiment, if the Player's hand ranks lower than the Banker's, this wager loses. If the Player's and the Banker's hand rank the same, two hands push and this wager neither wins nor loses. If the Player's hand ranks higher than the Banker's, this wager wins and is paid either Even Money (1 to 1) or one half of the wager (1 to 2) if the Bankers losing hand is a predetermined ranking hand or a lower ranking hand such as the Banker's losing is King-Ten or lower, King-Nine or lower, Queen-Jack or lower, Queen-Ten or lower, Jack-high or lower, etc.

In another embodiment, if the Banker's hand is 'not' a qualifying hand of a King-Queen-high hand (such as a hand of KQ987) or a better hand (such as a hand of AAJ85), this wager wins and is paid one half of the wager. If the Player's hand ranks lower than the Banker's hand and the Banker's hand is King-Queen or better, this wager loses. If the Player' and the Banker's hand rank the same and the Banker's hand is King-Queen or better, two hands push and this wager neither wins nor loses. If the Player's hand ranks higher than the Banker's and the Banker's hand is King-Queen or better, this wager wins and is paid Even Money (1 to 1).

In another embodiment, if the Banker's hand is not a qualifying hand of a predetermined ranking hand or a better ranking hand, such as a qualifying hand of King-Jack or buffer, King-Ten or better, King-Nine or better, Queen-Jack or better, etc., this wager wins and is paid one half of the wager (1 to 2). If the Player's hand ranks lower than the Banker's and the Banker's hand is a qualifying hand, this wager loses. If the Player's and the Banker's hand rank the same and the Banker's hand is a qualifying hand, two hands push and this wager neither wins nor loses. If the Player's hand ranks higher than the Banker's hand and th Banker's hand is a qualifying hand, this wager wins and is paid Even Money (1 to 1).

In another embodiment, if the Banker's hand is not a qualifying hand of a predetermined ranking hand or a better ranking hand such as a qualifying hand of King-Ten or better, King-Nine or better, Queen-Jack or better, Queen-Ten or better, Jack-Ten or better, etc., this wager pushes and no money is won or lost. If the Player's hand ranks lower than the Banker's and the Banker's hand is a qualifying hand, this wager loses. If the Player's and the Banker's hand rank the same and the Banker's hand is a qualifying hand, two hands push and this wager neither wins nor loses. If the Player's hand ranks higher than the Banker's hand and the Banker's hand is a qualifying hand, this wager wins and is paid Even Money (1 to 1).

In another embodiment, if the Player's hand ranks lower than the Banker's, this wager loses. If the Player's and the Banker's hand rank the same, two hands push and this wager neither wins nor loses. If the Player's hand ranks higher than the Banker's, this wager wins and is paid Even Money (1 to 1), less a certain percent commission such as a 5% commission, a 4% commission, etc.

Pair of Aces or Better Bet

Pair Of Aces Or Better Bet allows a Player to bet on the contents of his or her unseen hand. This wager wins if the Player's best 5-card poker hand is a pair of Aces or better (Two Pair, 3 of a Kind, Straight, Flush, Full House, 4 of a Kind, Straight Flush, Royal Flush or 5 Aces); this wager loses if the Player's best 5-card poker hand is any other type of hand. In the preferred embodiment, Pair Of Aces Or Better Bet pays Even Money (1 to 1) on a hand of Two Pair of better, and pays 3 to 2 on a hand of two or more Aces in either the Player's best 5-card poker hand or the Player's seven cards; this payout odds yields a house advantage of 1.81%. In another embodiment, Pair Of Aces Or Better Bet pays Even Money (1 to 1) on a hand of a pair of Aces, Two Pair, 3 of a Kind, Straight or Flush, and pays 5 to 2 on a hand of Full House or better; this payout odds yields a house advantage of about 2.97%. Alternatively, other appropriate payout odds can be created by adjusting the suggested payouts of Pair Of Aces Or Better Bet.

The Deal

In the preferred embodiment, the invention uses a standard poker deck of 52 cards plus on Joker. In other embodiments of the invention use at least one standard poker deck of 52 cards plus at least one Joker.

In the preferred embodiment, the invention offers seven positions. Table size, management of Players and their bets, and speed of play are the key reasons for the choice of seven positions. Alternatively, lesser or greater than seven positions can be created in accordance with this invention if, for example, multiple decks are used.

In the preferred embodiment, the Banker receives his or her own seven-card dealt hand and each Player receives his or her own seven-card dealt hand, starting from the Player sitting to the immediate left of the dealer, continuing in a clockwise fashion and ending with the Dealer. Cards are preferably dealt to each Player and to the Banker one card at a time for seven times if the cards are shuffled by a dealer; the cards are preferably dealt to each Player and to the Banker in a stack of seven cards if the cards are shuffled by a shuffling device. In another preferred embodiment, seven seven-card dealt hands are always dealt regardless of the actual number of players; and some random number generation device such as a random number generator display or a dice shaker, is used to assign the dealt hands to players to reduce the likelihood of problems in dealing. Other traditional methods used in other poker games may be used for the deal.

In another embodiment, each Player and the Banker may receive their own hand in either one of the following fashions:

1. they receive their own six cards and one community card;
2. they receive their own five cards and two community cards;
3. they receive their own four cards and three community cards;
4. they receive their own three cards and four community cards;
5. they receive their own two cards and five community cards;
6. they receive their own one card and six community cards; and
7. they receive no card of their own and seven community cards.

After at least one wager is placed, the cards are thoroughly shuffled either by a shuffling device or by a dealer, and are dealt into enough dealt hands of seven cards to provide a dealt hand for each Player and for the Banker. Once the dealer has delivered the cards to all players, the dealer turns over the Banker's seven cards face up with only the top card exposed. From each Player's own seven cards, each Player selects his or her best 5-card poker hand, discards two other cards, and places his or her cards face down on th appropriate spaces of the table layout. The dealer then reveals the Banker's six remaining cards, selects the Banker's best 5-card poker hand, discards two other cards, opens the cards of the Player at the immediate right of the dealer, and settles the Player's Pair Of Aces Or Better Bet wager first, then settles the Player's Poker Bet wager. The dealer collects the losing chip(s) before paying the winning bet(s). After completing the transaction of the Player at the immediate right of the dealer, the dealer moves on and completes the transaction of the next Player in the game, and so on. Upon the completion of all transactions, a new round of play will begin.

Tables for Use in Play

Play may be facilitated by using tables configured and marked as shown in FIG. 1. FIG. 1 shows a casino table playing surface of the invention. A Player may make a Pair Of Aces Or Better Bet wager in area 1 and/or a Poker Bet wager in area 2. After the Player selects his or her best 5-card poker hand from his or her own seven cards, the Player places his or her best 5-card poker hand in area 3 and two discards in area 4. Area 5 is a reminder pay table for dealers to use. And area 6 is where a dealer places the Banker's cards.

FIG. 2 is a copy of a rules card for a casino card game of the invention. It covers the use of a standard poker deck of 52 cards plus one Joker, the function of the Joker, one or up to six Players play against the dealer who always acts as the Banker, the game rules of Poker Bet and how a Poker Bet wager is settled, and the game rules of Pair Of Aces Or Better Bet and how a Pair Of Aces Or Better Bet wager is settled.

Alternatively, other appropriate playing surfaces may be used in connection with the card game of the invention.

What is claimed is:

1. A method of playing a card game comprising the following steps:

(a) providing and shuffling at least one standard poker deck of 52 cards plus at least one Joker; wherein each said Joker can be used as an Ace, or to form a Straight or Flush;

(b) each Player placing either a Pair Of Aces Or Better Bet wager betting on the content of the Player's hand or a Poker Bet wager betting against the Banker's hand, or both;

(c) dealing cards into enough dealt hands of seven cards to provide a dealt hand for each Player and for the Banker;

(d) determining which dealt hand is assigned to each Player and which dealt hand is assigned to the Banker;

(e) from their own seven-card dealt hand, each Player and the Banker selecting their own best 5-card poker hand and discarding two other cards;

(f) determining whether each Player's Pair Of Aces Or Better Bet wager wins or loses, if any; wherein a Player's Pair Of Aces Or Better Bet wins if the Player's best 5-card poker hand is a pair of Aces, Two Pair, 3 of a Kind, Straight, Flush, Full House, 4 of a Kind, Straight Flush, Royal Flush or 5 Aces; wherein this wager loses if the Player's best 5-card poker hand is not one of aforesaid winning hands;

(g) settling each Player's Pair Of Aces Or Better Bet wager with the Banker;

(h) determining whether each Player's Poker Bet wager wins, loses or ties, if any; wherein each Player's best 5-card poker hand is compared to the Banker's according to the rankings of the Poker Bet game from the highest rank to the lowest rank as follows: 5 Aces, Royal Flush, Straight Flush, 4 of a Kind, Full House, Flush, Straight, 3 of a Kind, Two Pair, One Pair, and High Card; Ace is the highest High Card, following by King, Queen, Jack, Ten, 9, 8, 7, 6, 5, 4, 3 and 2; and (i) settling each Player's Poker Bet wager with the Banker.

2. The method of playing a card game according to claim 1, wherein the card game of the invention uses one standard poker deck of 52 cards plus one Joker; wherein the Joker may be used as an Ace, or to form a Straight or Flush.

3. The method of playing a card game according to claim 1, wherein the Player's winning Pair Of Aces Or Better Bet wager is paid Even Money, namely 1 to 1, on a hand of Two Pair or better; and is paid one and one half of the wager, namely 3 to 2, on a hand that has two or more Aces in either the Player's best 5-card poker hand or the Player's seven dealt cards.

4. The method of playing a card game according to claim 1, wherein the Player's winning Pair Of Aces Or Better Bet wager is paid Even Money, namely 1 to 1, on a hand of a pair of Aces, Two Pair, 3 of a Kind, Straight or Flush, and is paid 5 to 2 on a hand of Full House, 4 of a Kind, Straight Flush, Royal Flush or 5 Aces.

5. The method of playing a card game according to claim 1, wherein and the Player's Poker Bet wager settling with the Banker is determined as follows: If the Player's best 5-card poker hand ranks lower than the Banker's, this wager loses; if the Player's and the Banker's best 5-card poker hand rank the same, two hands push and this wager neither wins nor loses; if the Player's best 5-card poker hand ranks higher than the Banker's, this wager wins, and is paid neither Even Money, namely 1 to 1, if the Banker's losing hand is King-Queen or better, or one half of the wager, namely 1 to 2, if the Banker's losing hand is King-Jack or lower.

6. The method of playing a card game according to claim 1, wherein the Player's Poker Bet wager settling with the Banker is determined as follows: If the Player's best 5-card poker hand ranks lower than the Banker's, this wager loses; if the Player's and the Banker's best 5-card poker hand rank the same, two hands push and this wager neither wins nor loses; if the Player's best 5-card poker hand ranks higher than the Banker's, this wager wins, and is paid neither Even Money, namely 1 to 1, or one half of the wager, namely 1 to 2, if the Banker's losing hand is a predetermined ranking hand or lower.

7. The method of playing a card game according to claim 1, wherein the Player's Poker Bet wager settling with the Banker is determined as follows: If the Banker's best 5-card poker hand is not a qualifying hand of King-Queen or better, this wager wins and is paid one half of the wager, namely 1 to 2; if the Player's best 5-card poker hand ranks lower than the Banker's and the Banker's best 5-card poker hand is King-Queen or better, this wager loses; if the Player's and the Banker's best 5-card poker hand rank the same and the Banker's best 5-card poker hand is King-Queen or better, two hands push and this wager neither wins or loses; if the Player's best 5-car poker hand ranks higher than the Banker's and the Banker's best 5-card poker hand is King-Queen or better, this wager wins and is paid Even Money, namely 1 to 1.

8. The method of playing a card game according to claim 1, wherein the Player's Poker Bet wager settling with the Banker is determined as follows: If the Banker's best 5-card poker hand is not a qualifying hand of a predetermined ranking hand or better, this wager wins and is paid one half of the wager, namely 1 to 2, if the Player's best 5-card poker hand ranks lower than the Banker's and the Banker's best 5-card poker hand is a qualifying hand of the predetermined ranking hand or better, this wager loses; if the Player's and the Banker's best 5-card poker hand rank the same and the Banker's best 5-card poker hand is a qualifying hand of the predetermined ranking hand or better, two hands push and this wager neither wins or loses; if the Player's best 5-card poker hand ranks higher than the Banker's and the Banker's best 5-card poker hand is a qualifying hand of the predetermined ranking hand or better, this wager wins and is paid Even Money, namely 1 to 1.

9. The method of playing a card game according to claim 1, wherein the Player's Poker Bet wager settling with the Banker is determined as follows: If the Banker's best 5-card poker hand is not a qualifying hand of a predetermined ranking hand or better, this wager pushes and neither wins nor loses; if the Player's best 5-card poker hand ranks lower than the Banker's and the Banker's best 5-card poker hand is a qualifying hand of the predetermined ranking hand or better, this wager loses; if the Player's and the Banker's best 5-card poker hand rank the same and the Banker's best 5-card poker hand is a qualifying hand of the predetermined ranking hand or better, two hands push and this wager neither wins nor loses; if the Player's best 5-card poker hand ranks higher than the Banker's and the Banker's best 5-card poker hand is a qualifying hand of the predetermined ranking hand or better, this wager wins and is paid Even Money, namely 1 to 1.

10. The method of playing a card game according to claim 1, wherein the Player's Poker Bet wager settling with the Banker are determined as follows: If the Player's best 5-card poker hand ranks lower than the Banker's, this wager loses; if the Player's and the Banker's best 5-card poker hand rank the same, two hands push and this wager neither wins nor loses; if the Player's best 5-card poker hand ranks higher than the Banker's, this wager wins, and is paid Even Money, namely 1 to 1, less a certain percent of commission.

11. The method of playing a card game according to claim 1, wherein the Joker may be used as any card.

12. The method of playing a card game according to claim 1, wherein A2345 is the lowest Straight.

13. The method of playing a card game according to claim 1, wherein each Player and the Banker may receive their own hand in either one of the following fashions:

(a) they receive their own seven cards and no community card;

(b) they receive their own six cards and one community card;

(c) they receive their own five cards and two community cards;

(d) they receive their own four cards and three community cards;

(e) they receive their own three cards and four community cards;

(f) they receive their own two cards and five community cards;

(g) they receive their own one card and six community cards; and (h) they receive no card their own and seven community cards.

14. The method of playing a card game according to claim 1, wherein A2345 is the $2^{nd}$ highest Straight.

15. The method of playing a card game according to claim 1, wherein the Player's Poker Bet wager settling with the Banker are determined as follows: If the Player's best 5-card poker hand ranks lower than the Banker's, this wager loses; if the Player's and the Banker's best 5-card poker hand rank the same, two hands push and this wager neither wins nor loses; if the Player's best 5-card poker hand ranks higher than the Banker's, this wager wins, and is paid Even Money, namely 1 to 1, less a 5% commission.

16. The method of playing a card game according to claim 1, wherein the card game of the invention uses one standard poker deck of 52 cards plus one Joker; wherein the Joker may be used as any card.

* * * * *